United States Patent [19]

Creaser, Jr.

[11] Patent Number: 4,567,487

[45] Date of Patent: Jan. 28, 1986

[54] VIBRATION-TOLERANT WHIP ANTENNA

[75] Inventor: Charles W. Creaser, Jr., Hollis, N.H.

[73] Assignee: Chu Associates, Inc., Littleton, Mass.

[21] Appl. No.: 620,874

[22] Filed: Jun. 15, 1984

[51] Int. Cl.[4] ..... H01Q 1/10; H01Q 1/20

[52] U.S. Cl. ..... 343/900; 343/DIG. 1

[58] Field of Search ..... 343/715, 900, 901, DIG. 1

[56] References Cited

U.S. PATENT DOCUMENTS 3,229,296 1/1966 Saari ..... 343/900

FOREIGN PATENT DOCUMENTS 1152309 2/1958 France ..... 343/DIG. 1

629092 9/1949 United Kingdom ..... 343/900

OTHER PUBLICATIONS

Vibration Damping Aircraft Antenna; IBM Technical Disclosure Bulletin, vol. 21, No. 6, Nov. 1978.

*Primary Examiner*—Eli Lieberman

*Attorney, Agent, or Firm*—Rines and Rines Shapiro and Shapiro

[57] ABSTRACT

A mechanical vibration-tolerant whip antenna having, in combination, a multi-section conical metal tube having successive sections each joined by an internal rigid rod tightly fitting within a corresponding recess in the respective ends of each of the adjacent sections to be joined with the outer metal surfaces of the successive sections providing a continuous smooth external metal surface transition, and each rigid rod extending sufficiently above and below a node of mechanical vibration resonance to provide a rigid support to the node. Additional vibration-tolerance is achieved by vibration damper inserts disposed within the tube near each node of resonance to damp vibration of the tube.

9 Claims, 3 Drawing Figures

VIBRATION-TOLERANT WHIP ANTENNA

Figure 1:
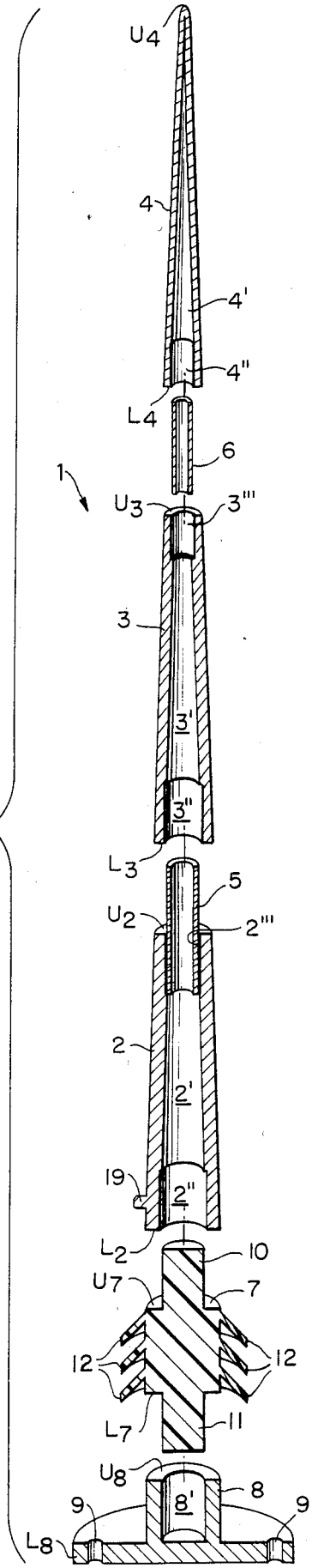

The present invention relates to a general purpose whip-type antenna for use in signal transmitting or receiving, being more particularly directed to a mechanical vibration-tolerant whip antenna provided with vibration dampening means to reduce the deleterious effects of both forced and resonant mechanical vibrations of the antenna.

The art of whip antenna construction is plagued with the problem of providing structures that are capable of withstanding mechanical vibration, especially forced and resonant or periodic vibration, produced by extreme environmental conditions and methods of use. Additionally, the vibration problem is particularly exacerbated by the traditional method of base mounting, with the majority of the structure lacking lateral stabilization. Multiple mounting points, along the length, are not feasible in most applications and introduce electrical performance difficulties. as well.

Presently, whip antennas are fabricated of cylindrical or conical (tapered) lengths of metal or fiberglass-and-resin compounds having embedded conductors such as metal conductive wires. The metal whip antennas, being solid, are excessively heavy for most uses, and milling out excess material from the center of an extended length of antenna is costly and additionally reduces the structural integrity of the antenna. Fiberglass antenna structures are substantially lighter than their metal counterparts, but under extended vibration or extreme environmental conditions producing substantial shock and vibration, they tend to de-laminate and otherwise lose structural integrity. Without such structural integrity, the embedded conductive wires tend to break, destroying the effectiveness of the antenna.

Additionally, since whip antennas are presently often produced from a single extended cylindrical or conical (tapered) member, specific preselected lengths are difficult to achieve. If an exceedingly long-length antenna is desired, special manufacturing must be obtained to provide the single long-length whip antenna and special transportation arrangement must be made to deliver the antenna to the desired location for use—requiring undesirable production time and cost. Alternatively, successive shorter length whip sections can be joined or connected together, as by ring brackets, welding, splicing or bolting the sections together. Each of these methods of antenna construction, however, provides regions of the overall antenna in the vicinity of the joints which are vibration-sensitive mechanical stress regions subject to fracture under extreme or continued vibration, with resulting loss of integrity of electrical connection from section to section. The above described methods of joining or connecting shorter length sections to form a single long antenna, moreover, involve discontinuities in the outer surface of the antenna.

In accordance with the present invention, on the other hand, a smooth, continuous tapered outer surface is provided for the whip antenna, greatly increasing its useful life under extreme environmental conditions, with the aid of rigid tightly fitted coupling insert members interiorly joining successive exteriorly conical sections, providing excellent mechanical and electrical contact between the successive sections.

Additionally, since whip antennas—as other long and narrow structures—tend to have characteristic mechanical resonant frequencies, with nodes being critical stress points or regions as the whip structure is set into lateral bending, it has been discovered that strengthening the successive sections at such nodes alleviates the necessity for reinforcing the entire length of the whip, providing substantial overall structural stability to the entire whip antenna under vibration and without substantially increasing the overall weight.

Vibration dampers, although not new of themselves in the art, can also be used in conjunction with the invention. Presently vibration dampers, such as a weighted cord, chain or cable suspended from the top of a whip structure to or near the bottom of the antenna—generally being suspended internally of a hollow structure whip antenna—provides a counter force against vibration as the whip is mechanically displaced beyond a certain lateral distance. Such a vibration damper, however, has two fundamental drawbacks. First, a weighted cord damper can only be effectively used on an essentially bottom mounted, vertically extending whip antenna. Since gravity provides the restoring force and the primary dampening of the cord, it is necessary that the majority of the weight of the cord be along its length—requiring vertical mounting only. Since the primary effectiveness of the cord as a damper for the whip antenna results from the cord slapping against the transversely moving walls of the whip, the cord must be free to swing freely against the walls of the whip—also limiting operation to substantially vertical whip antenna orientation. A further fundamental disadvantage with the weighted cord damper is that the dampening capability is distributed over essentially the entire length of the whip and is not focused directly on the resonant nodes or stress points where greatest transverse or lateral movement occurs, rendering the dampening inefficient.

Using vibration dampers constructed in accordance with the present invention, to the contrary, involves placing one or more dampers selectively at or near the mechanical stress points which may be the mechanical resonant nodes along the length of the whip antenna and, in a preferred mode, in essential conjunction with the rigid internal section coupling previously discussed. Such vibration dampers are focused at the critical vibration points, rapidly to reduce the unwanted vibration. Such dampers may be used, furthermore, with other than vertical mounting of the whip antenna, as well.

It is accordingly an object of the present invention to provide a new and improved mechanically vibration-tolerant whip antenna that shall not be subject to the above-described prior art limitations, but that, to the contrary, provides a light electrically conductive structure that minimizes the deleterious effects of periodic and shock vibrations produced by extreme environmental conditions during use.

An additional object is to provide such a novel whip antenna that can be constructed to any suitable length by connection of successive sections while retaining a continuous smooth outer surface and structural integrity under vibration.

Another object is to provide such a novel whip antenna that is structurally reinforced at critical vibration stress points or regions including mechanical resonant nodes along the antenna length to reduce unnecessary weight of the antenna and retain structural integrity under vibration-producing conditions.

A further object is to provide a novel whip antenna that has mechanical vibration dampers placed in proximity to critical vibration stress points along the length of the antenna to focus the vibration dampening at the critical stress points, and that may be used with antennas mounted vertically and other orientations.

Other and further objects are explained hereinafter and are more particularly delineated in the appended claims.

In summary, however, from one of its important aspects, the invention embraces a mechanical vibration-tolerant whip antenna having, in combination, a multi-section conical metal tube having successive sections joined by internal rigid reinforcing member means tightly fitting within corresponding recesses means in the respective ends of adjacent sections and with the outer metal surfaces of the successive sections providing a continuous smooth external metal surface transition, the lengths of the sections being selected to locate mechanical vibration stress points at their adjacent ends, and each reinforcing member means extending sufficiently above and below such stress points to provide rigid support to the same. Preferred details, best mode embodiment and other inventive features are hereinafter presented.

Figure 2:
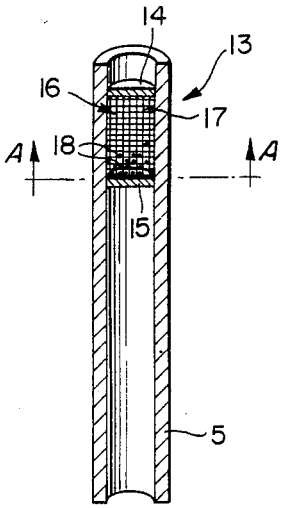
Figure 3:
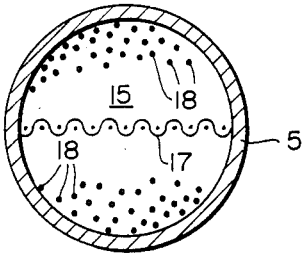

The invention will now be described in connection with the accompanying drawings, FIG. 1 of which is an elevational sectional view of a whip antenna and mounting apparatus constructed in accordance with the present invention, broken-away along its length to show multiple successive conical sections connected with rigid internal reinforcing members;

FIG. 2 is a similar sectional view, upon a slightly enlarged scale, of a rigid internal reinforcing member with its integral mechanical vibration damper; and FIG. 3 is a sectional top view of the vibration damper taken along the line A—A of FIG. 2, but on a more enlarged scale.

In FIG. 1, the mechanically vibration-tolerant whip antenna according to the present invention is generally designated at 1. The whip antenna 1 is shown having three successive conical metal tubular sections 2, 3 and 4 having both good structural mechanical and electrically conductive properties, as of spun aluminum tubing. The successive conical metal tubular sections 2, 3 and 4 each defines correspondingly conically tapered interior openings 2', 3' and 4' with the walls of successive sections 2, 3 and 4 essentially of equal thickness substantially throughout their individual lengths. Each metal section 2, 3 and 4 has an upper open end $U_2$, $U_3$ and $U_4$ and a lower open end $L_2$, $L_3$ and $L_4$, with the tapering outer diameter continuously and smoothly reducing from a maximum at $L_2$ to a minimum at $U_4$. The top end $U_4$ may be capped or sealed as shown. Additionally, at each point or region where two successive conical sections are to be joined, their adjacent ends have the same outer diameter so that, when joined, the successive conical sections provide a single continuous smooth conical outer surface.

Immediately above the respective lower ends $L_2$, $L_3$ and $L_4$ the successive sections are milled or otherwise provided with recessed portions 2'', 3'' and 4'', respectively, located internally adjacent the inner walls of the corresponding sections 2, 3, and 4 extending along a short portion of the length thereof. Similar internal recesses 2''' and 3''' are disposed internally adjacent the inner walls of the sections 2 and 3 along a short portion of the length thereof immediately below their respective upper ends $U_2$ and $U_3$.

The successive sections of the whip antenna 1 are provided with rigid reinforcing coupling rods or members 5 and 6, for the successive sections 2 and 3, and 3 and 4, respectively. The coupling rods 5 and 6 may be solid throughout, as of metal, or hollow cylinders, as shown, and are to be tightly fitted within recessed portions 2'''-3'' and 3'''-4'', respectively, to extend therealong and thereby join the successive conical sections 2-3 and 3-4 to form the single unitary continuously smooth outer-surfaced whip antenna 1. Since the outer diameter of the successive antenna sections 2 and 3 at the respective adjacent ends $U_2$ and $L_3$ is the same, as are the diameters at the lower end $L_4$ of section 4 and at the upper end $U_3$ of section 3, the conical sections 2 and 3 and 4, as joined or connected, provide a single continuously smooth conical tubular antenna. In preferred mode, the connecting and reinforcing coupling rods 5 and 6 are coated, before insertion into the recesses 2''' and 3'' and 3'''-4'', respectively, with an electrically conductive anti-seize compound, such as white petroleum jelly mixed with fine aluminum powder, to provide additional electrical connection between the sections and to facilitate removal of the coupling rods for disassembly purposes.

The antenna is base mounted with the aid of a dielectric insulator insert 7 as of fiberglass, for example. The base insulator 7 has an essentially cylindrical outer configuration and is preferably of solid construction throughout, with an upper shoulder $U_7$ of the same diameter as that of the lower end $L_2$ of the bottom conical section 2, and a lower shoulder $L_7$ of diameter equal to that of an upper end $U_8$ of a mounting base 8, as of aluminum or steel, for attachment to whatever surface the antenna 1 is to be mounted upon, by the larger stability-providing base plate $L_8$, as by a plurality of radially dispersed mounting or bolt holes 9. The base insulator 7 thus connects the antenna to the base mounting 8 with the coupling plug extension 10 tightly fitted within recess 2'' at the bottom end $L_2$ of bottom antenna section 2, and the lower coupling extension 11 tightly fitted within the recess 8' of the base mounting 8. The base insulator 7 may also be provided with one or more downwardly inclined drip rings 12 secured to the base insulator 7 to reduce the risk of electrical contact from the metallic antenna 1 to the metallic mounting base 8 as by rain or condensation during operation.

In use, the antenna 1 may be subject to the before-described conditions of mechanical shock or vibration. As noted, the antenna will tend to vibrate in a fixed periodic manner about nodal points determined primarily by the length of the antenna 1. For example, a 35 foot antenna 1 of spun aluminum conical sections 2, 3 and 4 having a lower-most outer diameter of 8 inches at lower end $L_2$ tapering down to an uppermost outer diameter of 3 inches at upper end $U_4$, has resonant vibration nodes at approximately 14 feet and 25 feet above the lower-most point of the antenna. As noted previously, these regions are particularly susceptible to fatigue and breakage and, according to the present invention, are specifically strengthened by locating the coupling rods 5 and 6 to extend sufficiently above and below locations of the resonance nodes.

In addition to providing rigid support and mechanical vibration distribution at the critical resonance nodes, mechanical vibration dampers may be used, in accordance with the invention, to reduce the lateral mechanical movement or displacement of the antenna 1, by placing the dampers in close proximity to the nodal regions or points. Referring now to FIG. 2, the coupling rod 5 is shown, on enlarged scale, with an integral mechanical vibration damper(s) generally designated at 13.

While the mechanical vibration damper 13, FIGS. 2 and 3, is constructed to provide dampening for lateral or horizontal vibrational displacement, it may be constructed to provide vibration dampening in other directions, as by re-orientation of the damper 13, with the axis of the damper being perpendicular to the vibrational displacement and normal to the forces of gravity. While the damper may be of a variety of center-of-gravity displacement types, the preferred damper 13 has a top plate 14 and a bottom plate 15, such as circular metal plates, secured within the hollow cylindrical cavity of rod 5, as by welding, such that a sealed cavity 16 is produced between the plates 14 and 15 and within the walls of rod 5. Within the sealed cavity 16 is secured a wire mesh 17, which is attached, as by welding, to the internal walls of the rod 5 within the sealed cavity 16 and the top and bottom plates 14 and 15, respectively. Also, within the sealed cavity 16 are a plurality of weighted pellets or balls, such as steel or lead shot 18, that normally rest against the bottom plate 15 and are free to move within the sealed cavity 16. The wire mesh 17 is designed such that the gap between the wires is larger than the diameter of the shot 18 to allow movement of the shot 18 through the wire mesh 17. It has been found that the size of the gap in the wire mesh 17 should be from three to four (3–4) times the diameter of the shot 18 to provide proper passage of the shot 18 through the mesh 17.

In operation, vibrational forces cause the antenna 1 to swing or displace laterally, with components perpendicular to the longitudinal axis of the antenna 1 such that the critical resonance nodes, located in close proximity to the mechanical vibration dampers 13, are displaced periodically substantially along the longitudinal axis of the antenna 1. As the resonance nodes move, the closely associated rigid connecting rods, such as rod 5, are transversely displaced causing transverse displacement of the damper 13. When the damper 13 is displaced, the shot pellets 18 will resist the displacement due to the lack of equal directional displacement momentum and will thus reduce the extent of displacement. Upon reverse lateral or transverse displacement, which occurs in periodic swinging or waving of the antenna 1, especially at resonant or harmonic vibration frequencies, the shot pellets 18 will be moving inside the sealed cavity 16 in a direction opposite to the reverse transverse directional displacement and will impart, by collision contact with the wires of mesh 17 and the interior wall of rod 5, opposite or restoring momentum force. Since the shot 18 can move within substantially the entire area of sealed cavity 16, the restoring momentum force will be imparted on the rod 5, and therefore the antenna 1, out of phase with the frequency of periodic transverse movement of the antenna's resonance nodes, thereby dampening the vibration produced periodic displacement.

Once constructed as described above, the antenna 1 provides a mechanical-tolerant whip antenna with a smooth electrically conductive outer surface transition that is easily mounted to a surface. Electrical connection can be achieved to the antenna by a metallic feed point 19 securely attached to or integral within a portion of the antenna, such as conical section 2 as shown in FIG. 1. In operation, multiple rigid rods, such as 5 and 6, are used with associated vibration dampers, such as damper 13, one at each of the resonance node locations discussed previously. Additionally, a vibration damper may be attached to the top of the antenna 1, such as at upper end $U_4$, without rigid rod support, to inhibit or reduce transverse movement at the top of the antenna 1, which is a critical vibration point as previously noted, where additional rigid support may be unnecessary.

Returning to the previously stated example of a 25 foot aluminum antenna, when the mounting base 8 was excited by both vertical and horizontal mechanical frequencies between 4 and 100 Hz, resonant periodic frequencies were noted at 7,16.5, 35, 53 and 79 Hz. With rigid supporting-connecting rods, as 5 and 6, extending above and below the resonance node points at 14 feet and 25 feet and three (3) mechanical vibration dampers, as damper 13—each loaded with 3.3 lbs. of 3/16 inch diameter metal shot 18 (such as No. 6 lead shot) and a $\frac{1}{4}$–$\frac{3}{8}$ inch wire mesh grating 17—one damper located adjacent each two resonance node points and attached to the rods 5 and 6 and one located at the top of the antenna 1, at upper end $U_4$, substantial mechanical vibrational tolerance was achieved.

While the exemplary description of the antenna has involved cylindrical circular cross sectional structures, other longitudinally extending structures are also contemplated such as those having triangular, square, rectangular or other polygonic or curved cross-sectional configurations and, as such, fall within the scope and intent of the present invention—the term cylindrical being used in its generic mathematical sense. Further modifications will also occur to those skilled in the art, and such are considered to fall within the spirit and scope of the invention as defined in the appended claims.

What is claimed is:

1. A mechanical vibration-tolerant whip antenna having, in combination, a multi-section conical metal tube having successive sections joined by internal rigid reinforcing member means tightly fitting within corresponding recesses in the respective ends of adjacent sections and with the outer metal surfaces of the successive sections providing a continuous smooth external metal surface transition, the lengths of the sections being selected to locate mechanical vibration stress points at their adjacent ends, and each reinforcing member means extending sufficiently above and below such stress points to provide rigid support to the same.

2. A whip antenna as claimed in claim 1 and in which said stress points correspond to mechanical resonance nodes.

3. A whip antenna as claimed in claim 2 and in which vibration damper insert means is disposed within the tube sections near each resonance node to damp lateral vibration.

4. A whip antenna as claimed in claim 1 which includes vibration damper insert means disposed within and near the top of the upper antenna tube section.

5. A mechanical vibration-tolerant whip antenna having, in combination, a multi-section conical metal tube having successive sections joined by internal rigid reinforcing member means tightly fitting within corresponding recesses in the respective ends of adjacent sections and with the outer metal surfaces of the successive sections providing a continuous smooth external metal surface transition, and vibration damper insert means disposed within the tube sections at the internal rigid reinforcing member means.

6. A whip antenna as claimed in claim 5 in which the rigid reinforcing member means extends sufficiently above and below a node of mechanical resonance of the antenna to provide rigid support to the node.

7. A whip antenna as claimed in claim 6 in which one or more vibration damper insert means is provided rigidly secured to the internal rigid reinforcing member means.

8. A whip antenna as claimed in claim 5 in which a vibration damper is disposed within the antenna tube near nodes of mechanical resonance.

9. A whip antenna as claimed in claim 7 and in which said vibration damper insert means comprise pellet center-of-gravity displacement means.

* * * * *